United States Patent [19]

Kramer et al.

[11] Patent Number: 4,801,846

[45] Date of Patent: Jan. 31, 1989

[54] RARE EARTH HALIDE LIGHT SOURCE WITH ENHANCED RED EMISSION

[75] Inventors: Jerry Kramer, Acton; Walter P. Lapatovich, Hudson, both of Mass.

[73] Assignee: GTE Laboratories Incorporated, Waltham, Mass.

[21] Appl. No.: 112,026

[22] Filed: Oct. 23, 1987

Related U.S. Application Data

[63] Continuation-in-part of Ser. No. 943,461, Dec. 19, 1986, abandoned.

[51] Int. Cl.[4] ..... H01J 61/22

[52] U.S. Cl. ..... 313/641; 313/640

[58] Field of Search ..... 313/640, 641, 638, 639, 313/642, 25

[56] References Cited

U.S. PATENT DOCUMENTS

| | | | |
|---|---|---|---|
| 3,319,119 | 5/1967 | Rendina | 313/572 |
| 3,654,506 | 4/1972 | Kuhl et al. | 313/641 |
| 3,798,487 | 3/1974 | Zollweg et al. | 313/641 X |
| 3,852,630 | 12/1974 | Wesselink et al. | 313/640 |
| 4,027,190 | 5/1977 | Shintani et al. | 313/229 |
| 4,029,425 | 5/1977 | Higashi et al. | 313/562 |
| 4,171,498 | 10/1979 | Fromm et al. | 313/229 |
| 4,178,534 | 12/1979 | McNeill et al. | 315/39 |
| 4,243,906 | 1/1981 | Wilson | 313/229 |
| 4,360,758 | 11/1982 | Thornton et al. | 313/227 |

FOREIGN PATENT DOCUMENTS

| | | | |
|---|---|---|---|
| 2422411 | 12/1975 | Fed. Rep. of Germany | 313/641 |
| 93575 | 8/1976 | Japan | 313/641 |

OTHER PUBLICATIONS

N. J. Caruso, *An Improved Metal Halide Lamp with High Color Rendering Properties,* Journal of IES Transaction, pp. 206–219, Oct. 1983, discusses metal halide lamps utilizing iodides and bromides such as tin, calcium, and thallium iodides.

W. A. McAllister, *Color and Efficiency of Neodymium Iodide Discharges,* Journal Electrochem. Soc.: Solid State Science and Technology, pp. 2798–2800, Nov. 1985 discusses atomic radiation from a number of metals, added as iodides to high intensity mercury discharge arc tubes. He specifically discusses the iodides of neodymium and cesium.

R. W. B. Pearse, *The Identification of Molecular Spectra,* Fourth Edition, Chapman and Hall, pp. 128–129, (1965) discusses the identification of molecular spectra specifically calcium iodide.

*Primary Examiner*—David K. Moore
*Assistant Examiner*—Michael Horabik
*Attorney, Agent, or Firm*—Ivan Ericson

[57] ABSTRACT

This invention teaches a novel high pressure electric discharge lamp which has the desired properties of high efficacy, good color rendering, and a warm color temperature. These desired properties are attained by utilizing as fills the rare earth iodides in conjunction with calcium halides and, or sodium halides. Efficient visible emission from the rare earth atomic and molecular fragments in the discharge is combined with the red emission from calcium monohalide to provide an efficient, warm source.

14 Claims, 4 Drawing Sheets

RARE EARTH HALIDE LIGHT SOURCE WITH ENHANCED RED EMISSION

This is a continuation-in-part of co-pending application Ser. No. 943,461, filed on 12/19/86, now abandoned.

FIELD OF THE INVENTION

This invention relates to a high pressure electric discharge lamp. More particularly, this invention relates to a high pressure electric discharge lamp having an enhanced red emission.

BACKGROUND OF THE INVENTION

High pressure electric discharge lamps containing Hg and rare earth iodides are commercially available and used for studio lighting. These sources have high efficacy, greater than 80 LPW, good color rendering, CRI approx. equal to 85, and a high color temperature, approx. 6000° K. The high color temperature is compatible with photographic film. Sources for more general illumination should have the high efficacy and good color rendering of the rare earth studio lamps, but a warm color temperature, approximately 3,000° K., more representative of an incandescent source, would be desirable.

The high efficacy and good color rendering of rare earth halide lamps arises from both atomic and molecular emission from the arc. Many rare earth atomic emission lines in the visible region of the spectrum originate from the central core of the arc. Superimposed on the atomic emission spectrum is molecular emission from the rare earth subhalides, which comes from the mantle of the arc. Since the radiation from the rare earth halide sources is deficient in the red, compared to the blue and green, a high color temperature results.

One approach to lowering the color temperature is the addition of alkali atoms, such as sodium or lithium. These are added as the iodides to reduce reaction with the lamp envelope. The discharge typically contains cesium iodide to help broaden and stabilize the arc, and provide a source of atoms with low ionization potential (cesium ionization potential=3.9 eV). Ionized cesium provides the electrons necessary for maintaining the discharge and reduces the cesium neutral emission in the IR which lowers the efficacy of the lamp. Ionization of cesium also lowers the extent of ionization of the rare earth atoms. This is desirable because maximization of rare earth neutral atoms increases the visible emissions. Addition of sodium alone lowers the color temperature and increases the efficacy, but at the expense of color rendering. The sodium emission is predominantly located at 590 nm and tends to dominate the spectrum. Also, addition of the sodium can increase the rare earth ion to neutral ratio because of the higher ionization potential of sodium relative to cesium. Addition of lithium results in emission at 671 nm. Although emission from this line lowers the color temperature, the emission is far outside the photopic response, and efficacy decreases.

SUMMARY OF THE INVENTION

In accordance with one aspect of the present invention, a new and imroved electroded high pressure electric discharge lamp having an enhanced red emission comprises an outer envelope, a base, a refractory inner envelope, an inner refractory envelope support frame, two electrodes, a fill gas and electrical connectors. The fill gas consists essentially of mercury, calcium halides, an alkali halide, rare earth halides and an inert gas. The calcium halide, the alkali halide and rare earth halides are exclusive of fluorides. The fill gas is contained within the refractory inner envelope. The refractory inner envelope, the support frame, and the electrical connectors are contained within the outer envelope. The base is connected to the outer envelope and the electrical connectors. The electrical connectors are connected to the base, the refractory inner envelope and the electrodes.

In accordance with another aspect of the present invention, a new and improved electroded high pressure electric discharge lamp having an enhanced red emission comprises an outer envelope, a base, a refractory inner envelope, an inner envelope support frame, two electrodes, a fill gas and electrical connectors. The fill gas consists essentially of mercury, a calcium halide, a sodium halide, rare earth halides and an inert gas. The calcium halide, the sodium halide, and the rare earth halides are exclusive of fluorides. The fill gas is contained within the refractory inner envelope. The inner envelope, the support frame, the electrical connectors are contained within the outer envelope. The base is connected to the outer envelope and the electrical connectors. The electrical connectors are connected to the base, the inner transparent envelope and the electrodes.

In accordance with still another aspect of the present invention, a new and improved electrodeless high pressure electric discharge lamp having an enhanced red emission comprises a refractory inner envelope containing a fill gas. The fill gas consists essentially of mercury, a calcium halide, an alkali halide, rare earth halides and an inert gas. The calcium halide, the alkali halide and the rare earth halides are exclusive of fluorides. The fill gas is contained within the refractory inner envelope.

In accordance with still another aspect of the present invention, a new and improved electrodeless high pressure electric discharge lamp having an enhanced red emission comprises a refractory inner envelope containing a fill gas. The fill gas consists essentially of mercury, a calcium halide, a sodium halide, rare earth halides and an inert gas. The calcium halide, the sodium halide, and the rare earth halides are exclusive of fluorides. The fill gas is contained within the refractory inner envelope.

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

Figure 1:
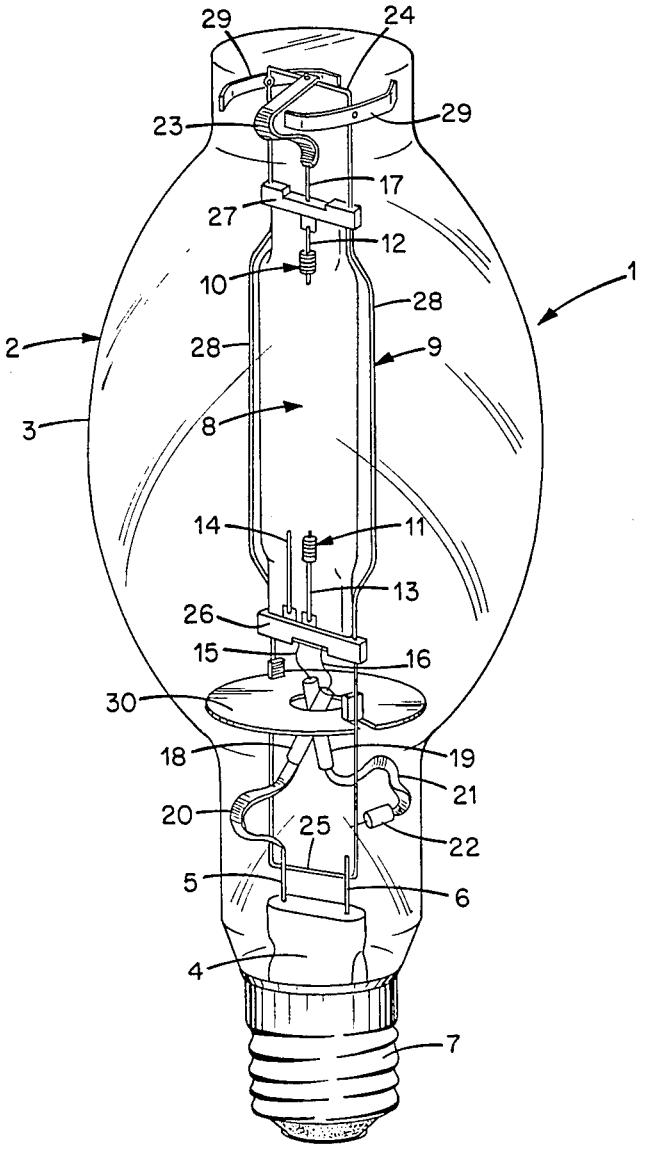
FIG. 1 is an elevational view of a high-pressure electric discharge lamp in accordance with the present invention.

Referring now to the drawing with greater particularity, there is shown in FIG. 1 one embodiment of the present invention, an electroded high pressure electric discharge lamp 1, which comprises an outer vitreous envelope 2 of generally tubular form having a central bulbous portion 3. Envelope 2 is provided at its end with a re-entrant stem 4 having a press through which extend relatively stiff lead-in wires 5 and 6 connected at their outer ends to the electrical contacts of the usual screw type base 7 and at their inner ends to the arc tube 8 and harness 9.

Arc tube 8 is generally made of quartz although other types of material may be used such as alumina, yttria or Vycor TM, the later being a glass of substantially pure silica. Sealed in the arc tube 8 at the opposite ends thereof are main discharge electrodes 10 and 11 which are supported on lead-in wires 12 and 13 respectively. Each main electrode 10 and 11 comprises a core portion which is made by a prolongation of the lead-in wires 12 and 13 and may be prepared of a suitable metal such as, for example, molybdenum and tungsten. The prolongations of these lead-in wires 12 and 13 are surrounded by molybdenum or tungsten wire helixes.

An auxiliary starting probe or electrode 14, generally made of tantalum or tungsten is provided at the base and of the arc tube 8 adjacent the main electrode 11 and comprises an inwardly projecting end of another lead-in wire 15.

Each of the current lead-in wires described have their ends welded to an intermediate foil section made of molybdenum which are hermetically sealed within the pinched sealed portions of arc tube 8. The foil sections are very thin, for example, approximately 0.0008" thick and go into tension without rupturing or scaling off when the heated arc tube pulls. Relatively short molybdenum wires 15, 16, and 17 are welded to the outer ends of the foil sections foil and serve to convey current to the various electrodes 10, 11, and 14 inside the arc tube 8.

Insulators 18 and 19 cover lead-in wires 15 and 16 respectively to preclude an electrical short between the lead-in wires 15 and 16. Molybdenum foil strips 20 and 21 are welded to lead-in wires 15 and 16. Foil strip 21 is welded to resistor 22 which in turn is welded to the arc tube harness 9. Resistor 22 may have a value, for example, 40,000 ohms and serves to limit current to auxiliary electrode 14 during normal starting of the lamp. Molybdenum foil strip 20 is welded directly to stiff lead-in wire 5. Lead-in wire 17 is welded at one end to a piece of foil strip which is sealed in the arc tube 8. The other end of the foil strip is welded to lead-in wire 12 which is welded to electrode 10. Molybdenum foil strip 23 is welded to one end of lead-in wire 17 and at the other end to the harness portion 24. The pinched or flattened end portions of the arc tube 8 form a seal which can be of any desired width and can be made by flattening or compressing the ends of the arc tube 8 while they are heated.

The U-shaped internal wire supporting assembly or arc tube harness 9 serves to maintain the position of the arc tube 8 sequentially coaxial with the envelope 2. To support the arc tube 8 within the envelope 2 lead-in wire 6 is welded to base 25 of harness 9. Because stiff lead-in wires 5 and 6 are connected to opposite sides of the power line, they must be insulated from each other, together with all members associated with each of them. Clamps 26 and 27 hold arc tube 8 at the end portions and fixedly attached to legs 28 of harness 9. Harness portion 24 bridges the free ends of harness 9 and is fixedly attached thereto by welding for imparting stability to the structure. The free ends of the harness 9 are also provided with a pair of metal leaf springs 29 frictionally engaging the upper tubular portion of lamp envelope 2. A heat shield 30 is disposed beneath the arc tube 8 and above resistor 22 so as to protect the resistor from excessive heat generated during lamp operation.

The arc tube 8 is provided with a fill gas consisting essentially of mercury, rare earth halides, a calcium halide, an alkali halide, and an inert gas. The rare earths are selected from the group consisting of La, Ce, Pr, Nd, Sm, Eu, Gd, Tb, Dy, Ho, Er, Tm, Yb, Lu, and mixture thereof. The halides, exclusive of fluorides are selected from the group consisting of chlorine, bromine, iodine, and mixtures thereof. The inert gas can be selected from the group consisting of neon, argon, krypton, xenon, and mixtures thereof. The alkali halide can be selected from the group consisting of the halides of lithium, sodium, potassium, rubidium, cesium, and mixtures thereof. The calcium halide can be selected from the group consisting of calcium chloride, calcium bromide, calcium iodide, and mixtures thereof. The fill gas of the present invention has been used in electrodeless lamps as well as the electroded lamps.

One particular fill of the present invention consists essentially of mercury, argon, and the halides of cerium, thulium, cesium, sodium, and calcium. Another fill of the present invention consists essentially of mercury, argon, and the halides of cerium, thulium, sodium and calcium. Still another fill of the present invention consists essentially of mercury, argon, and the halides of cerium, thulium, cesium, and calcium.

Figure 2:
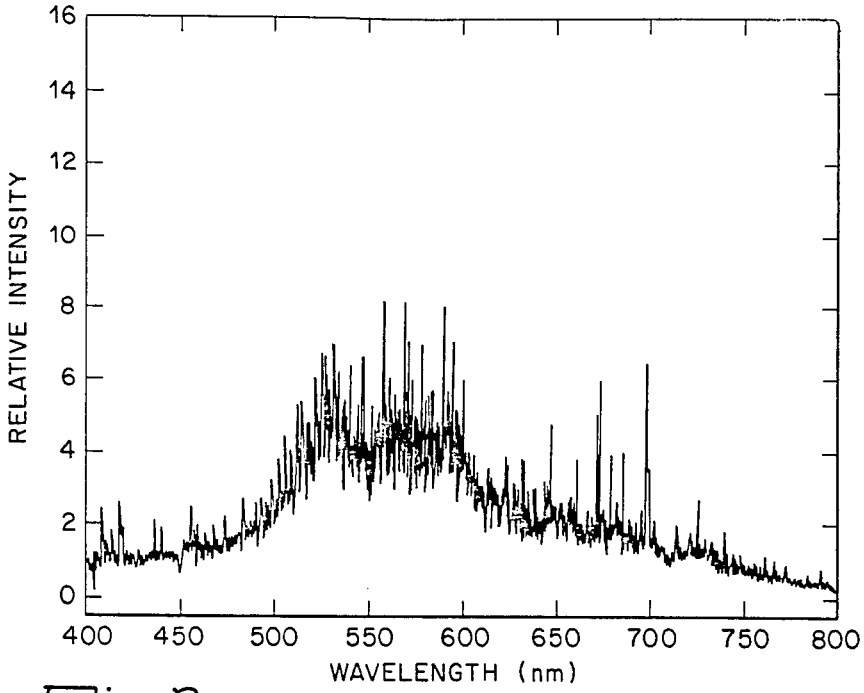
FIG. 2 is an emission spectrum of an electrodeless high pressure electric discharge lamp containing a lamp fill of $Hg/CeI_3/TmI_3/CsI$ and Ar.

In FIG. 2, an emission spectrum is shown of a electrodeless high pressure electric discharge lamp containing a lamp fill of mercury, cerium iodide, thulium iodide, cesium iodide and argon. The emission spectrum shown in FIG. 2 has poor red color rendition. However, in FIG. 3, in accordance with the present invention, an emission spectrum is shown of a electrodeless high pressure electric discharge lamp containing a lamp fill of calcium iodide in addition to mercury, cerium iodide, thulium iodide, cesium iodide and argon which has good red color rendition. The emission spectrum shown in FIG. 3 has an increased emission in the 620 nm and 650 nm region resulting in a warmer color temperature and an increased red color rendition as compared to the emission spectrum shown in FIG. 2. Electroded lamp spectra are similar.

Figure 4:
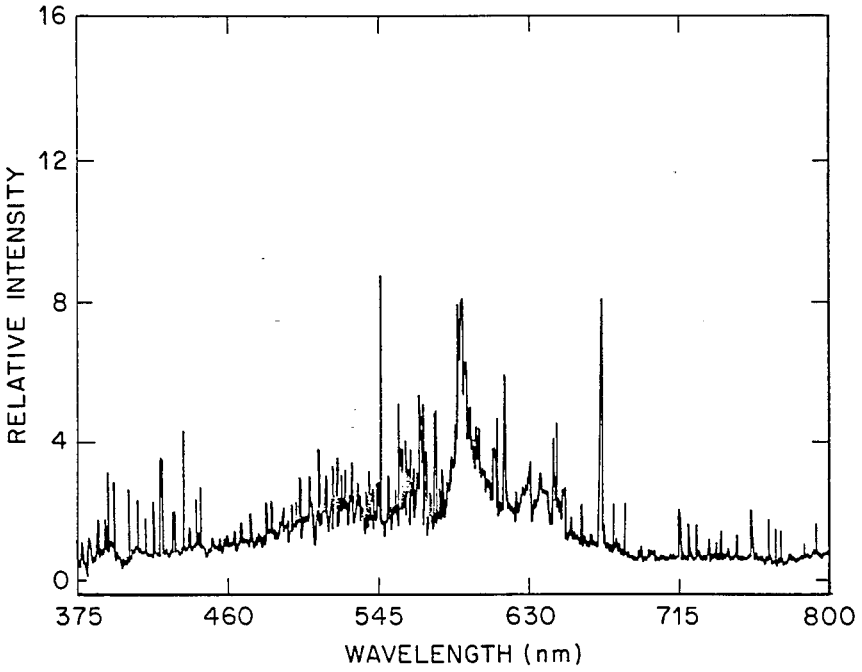
FIG. 4 is an emission spectrum of an electrodeless high pressure electric discharge lamp containing a lamp fill of $CaI_2$ and NaI in addition to $Hg/CeI_3/TmI_3$ and Ar in accordance with the present invention.

In FIG. 4, in accordance with the present invention, an emission spectrum of an electrodeless high pressure electric discharge lamp containing a lamp fill of calcium iodide and sodium iodide in addition to mercury, cerium iodide, thulium iodide and argon is shown. This lamp also shows an increased emission in the 620 nm to 650 nm region resulting in a warmer color temperature and an increased red color rendition. Electroded lamp spectra are similar.

Figure 5:
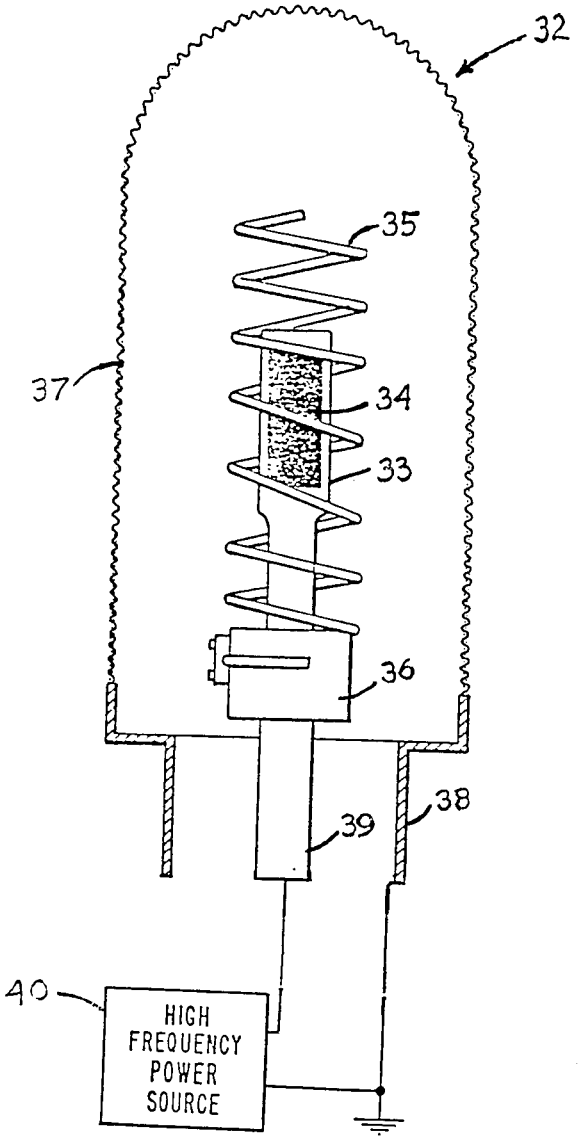
FIG. 5 is a schematic representation of a high-pressure electrodeless discharge apparatus in accordance with the present invention.

FIG. 5 is a schematic representation of an embodiment of a high-pressure electrodeless discharge apparatus in accordance with the present invention. Shown in FIG. 5 is a high-pressure electrodeless discharge lamp 32 having a discharge chamber 33 made of a light transmitting substance, such as quartz. Chamber 33 contains a volatile fill material 34. Volatile fill material 34 of discharge chamber 33 includes mercury, cerium iodide, thulium iodide, cesium iodide, calcium iodide and argon or includes mercury, cerium iodide, thulium iodide, sodium iodide, calcium iodide and argon. An RF coupling arrangement includes a spiral coil electrode 35 disposed around discharge chamber 33 and attached to fixture 36. A grounded conductive mesh 37 surrounds the discharge chamber 33 and spiral coil electrode 35 providing an outer electrode which is transparent to radiation from the discharge chamber 33. Spiral coil electrode 35 and grounded conductive mesh 37 are coupled by a suitable coaxial arrangement 38, 39 to a high frequency power source 40. The radio frequency electric field is predominantly axially directed coincident with the spiral axis of spiral coil electrode 35 and causes an arc to form within discharge chamber 33.

As used herein, the phrase "high frequency" is intended to include frequencies in the range generally from 100 MHz to 300 GHz. Preferably, the frequency is in the ISM band (i.e., industrial, scientific and medical band) which ranges from 902 MHz to 928 MHz. A particularly preferred frequency id 915 MH. One of the many commercially available power sources which may be used is an AIL Tech Power Signal Source, type 125.

Figure 3:
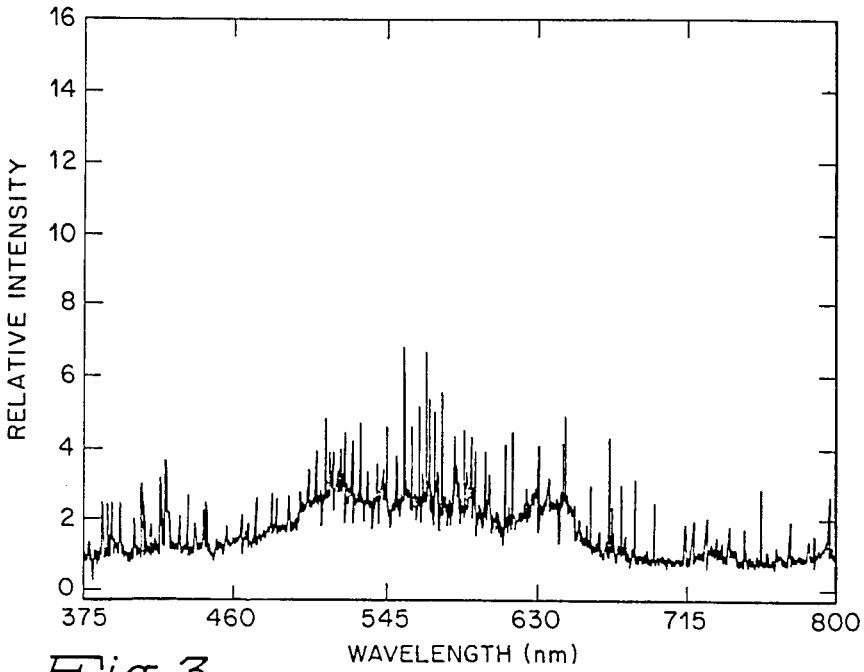
FIG. 3 is an emission spectrum of a electrodeless high pressure electric discharge lamp containing a lamp fill of $CaI_2$ in addition to $Hg/CeI_3/TmI_3/CsI$ and Ar in accordance with the present invention.

Visible radiation is produced by the resulting arc discharge within the lamp as depicted by the emission spectrum depicted in FIGS. 2, 3 and 4. Specific details of the structure of the apparatus of this general type are shown in U.S. Pat. No. 4,178,534 which issued Dec. 11, 1979, to McNeill, Lech, Haugsjaa, and Regan entitled "Method Of And Apparatus For Electrodeless Discharge Excitation".

The emission spectrum produced by the addition of calcium iodide is efficiently produced in a rare earth halide discharge and originates from the mantle of the discharge like the rare earth subhalide emission. There are relatively few atomic calcium emission lines in the visible, 423 nm being the strongest, and thus, atomic calcium emission does not significantly alter the emission spectrum of that discharge. In addition, the ionization potential of calcium at 6.1 eV is sufficiently high that little ionization of calcium occurs.

The vapor pressures of all the rare earth iodides are very close at 1100° K. and the temperature dependences of their vapor pressures are also similar. Thus, it is possible to utilize several rare earth iodides in a lamp and derive additive properties from their emission. Lamps containing rare earth halide additives must be operated at higher wall loadings and subsequent higher wall temperatures than lamps containing more volatile metal halides. The vapor pressure of calcium iodide is similar to that of the rare earth iodides. Consequently, addition of calcium iodide to the lamp does not require a change in the wall loading of rare earth containing lamps. The high wall temperature can increase wall reactions and decrease the lifetime of the lamp. However, both electrodeless and electroded lamps made from quartz and containing fills as described above were run successfully for hundreds of hours. One electroded lamp was tested for over 800 hours. These lamps also started easily and repeatedly. Alternate envelope materials such as alumina or yttria, which are designed for higher temperature operation than quartz, could be utilized to increase the operating lifetime of the source. The chemistry described herein should be applicable to ceramic envelopes.

TABLE I

RARE EARTH METAL HALIDE SUMMARY
LAMP FILL RANGES [mg/cm$^3$]
(Buffer gas pressure in torr)

| Fill Type | Hg | $CeI_3$ | $TmI_3$ | $CaI_2$ | CsI | NaI | Ar RF | Ar Electroded |
|---|---|---|---|---|---|---|---|---|
| B | | | | | | | | |
| High | 11.0 | 4.0 | 4.0 | 13.6 | 4.8 | — | 10.0 | 60 |
| Preferred | 9.0 | 2.5 | 2.5 | 8.5 | 3.0 | — | 7.5 | 50 |
| Most Preferred | 7.0 | 1.0 | 1.0 | 3.4 | 1.2 | — | 5.0 | 45 |
| Preferred | 4.0 | 0.5 | 0.5 | 1.8 | 0.6 | — | 2.8 | 15 |
| Low | 1.0 | 0.1 | 0.1 | 0.3 | 0.1 | — | 0.5 | 10 |
| C | | | | | | | | |
| High | 11.0 | 4.0 | 4.0 | 13.6 | — | 11.2 | 10.0 | 60 |
| Preferred | 9.0 | 2.5 | 2.5 | 8.5 | — | 7.0 | 7.5 | 50 |
| Most Preferred | 7.0 | 1.0 | 1.0 | 3.4 | — | 2.8 | 5.0 | 45 |
| Preferred | 4.0 | 0.5 | 0.5 | 1.8 | — | 1.4 | 2.8 | 15 |
| Low | 1.0 | 0.1 | 0.1 | 0.3 | — | 0.1 | 0.5 | 10 |

TABLE II

RARE EARTH METAL HALIDE LAMP SUMMARY
RF QUARTZ LAMPS

| Lamp No. | Efficacy $\eta$ [lm/W] | Color Tcc [K] | CRI Ra | Wall Temp [°C.] | Fill Type | Calcium RE | Alkali RE | Alkali Additive | Wall Loading $\theta$ [W/cm$^2$] |
|---|---|---|---|---|---|---|---|---|---|
| 86-016 | 70.00 | 4564 | 82.6 | >1100 | B | 3.06 | 3.05 | 0.75 | 40.3 |
| 86-014 | 79.4 | 4886 | 79.4 | >1100 | B | 1.53 | 1.90 | 0.75 | 40.1 |
| 86-013 | 86.0 | 5210 | 74.0 | 1095 | B | 0.77 | 1.33 | 0.75 | 39.7 |
| 86-003 | 97.7 | 4888 | 76.5 | >1100 | B | 1.53 | 1.01 | 0.40 | 39.3 |
| 85-139 | 90.2 | 4706 | 90.9 | >1100 | B | 3.06 | 1.02 | 0.25 | 39.7 |
| 85-140 | 89.2 | 4587 | 80.7 | >1100 | B | 0.77 | 1.03 | 0.58 | 37.7 |
| 86-006 | 50.9 | 4815 | 81.8 | >1100 | B | 3.06 | 4.06 | 1.00 | 40.7 |
| 86-005 | 66.2 | 4620 | 82.8 | >1100 | B | 1.53 | 2.53 | 1.00 | 39.5 |
| 86-004 | 79.0 | 4957 | 76.6 | >1100 | B | 0.77 | 1.77 | 1.00 | 40.7 |

These data show fill optimization studies resulting in L86-018 to 020. (See Table VI) The ratios shown are molar ratios. RE refers to the total molar rare earth concentration. Additive includes all metals except alkali and mercury.

TABLE III

RARE EARTH METAL HALIDE LAMP SUMMARY
RF QUARTZ LAMPS

| Lamp No. | Efficacy η [lm/W] | Color Tcc [K] | CRI Ra | Wall Temp [°C.] | Fill Type | Calcium RE | Alkali RE | Alkali Additive | Wall Loading θ [W/cm²] |
|---|---|---|---|---|---|---|---|---|---|
| 86-054 | 76.8 | 2917 | 84.97 | >1100 | C[Na] | 3.06 | 8.2 | 2.0 | 40.7 |
| 86-053 | 77.3 | 3776 | 85.38 | >1100 | C | 3.06 | 3.69 | 0.90 | 40.9 |
| 86-044 | 87.6 | 3528 | 81.85 | 1100 | C | 3.06 | 4.92 | 1.20 | 40.6 |
| 86-043 | 88.3 | 4043 | 84.75 | >1100 | C | 3.06 | 2.46 | 0.60 | 40.5 |
| 86-042 | 91.6 | 4072 | 85.79 | >1100 | C | 3.06 | 1.23 | 0.30 | 41.4 |

Above data show lamp performance as a function of sodium concentration.

TABLE IV

RARE EARTH METAL HALIDE LAMP SUMMARY
RF QUARTZ LAMPS

| Lamp No. | Efficacy η [lm/W] | Color Tcc [K] | CRI Ra | Wall Temp [°C.] | Fill Type | Calcium RE | Alkali RE | Alkali Additive | Wall Loading θ [W/cm²] |
|---|---|---|---|---|---|---|---|---|---|
| 86-056 | 78.5 | 4942 | 77.91 | 1000 | B | 2.45 | 0.98 | 0.284 | 41.0 |
| 86-050 | 85.3 | 4712 | >78.61 | 1100 | B | 2.04 | 0.82 | 0.270 | 40.7 |
| 86-049 | 71.7 | 4805 | 81.97 | 1100 | B | 2.45 | 0.98 | 0.284 | 40.5 |
| 86-048 | 80.4 | 4696 | >82.56 | 1100 | B | 3.06 | 1.23 | 0.30 | 40.5 |

Above data show lamp performance as a function of rare earth concentration.

TABLE V

RARE EARTH METAL HALIDE LAMP SUMMARY
RF QUARTZ LAMPS

| Lamp No. | Efficacy η [lm/W] | Color Tcc [K] | CRI Ra | Wall Temp [°C.] | Fill Type | Mercury Concentration [micromole] | Wall Loading θ [W/cm²] |
|---|---|---|---|---|---|---|---|
| 86-026 | 69.5 | 4690 | 76.6 | 1100 | B | 123.4 | 41.2 |
| 86-025 | 74.4 | 4576 | 79.6 | 1100 | B | 102.7 | 40.9 |
| 86-024 | 67.8 | 4280 | 94.0 | 1100 | B | 41.1 | 41.2 |
| 86-023 | 80.4 | 4642 | 82.0 | 1100 | B | 61.8 | 40.9 |

Above data show lamp performance as a function of Hg concentration for calcium/rare earth ratio of 3.06; alkali/rare ratio of 1.23; and, alkali/additive ratio of 0.30 - all held constant.

TABLE VI

RARE EARTH METAL HALIDE LAMP SUMMARY
RF QUARTZ LAMPS

| Lamp No. | Efficacy η [lm/W] | Color Tcc [K] | CRI Ra | Wall Temp [°C.] | Fill Type | Calcium RE | Alkali RE | Alkali Additive | Wall Loading θ [W/cm²] |
|---|---|---|---|---|---|---|---|---|---|
| 86-020 | 86.7 | 4661 | 81.8 | >1100 | B | 3.06 | 1.23 | 0.30 | 41.1 |
| 86-019 | 84.0 | 4495 | 82.8 | >1100 | B | 3.06 | 1.23 | 0.30 | 40.5 |
| 86-018 | 78.0 | 4492 | 83.4 | >1100 | B | 3.06 | 1.23 | 0.30 | 41.0 |

Above data show reproducibility of lamp performance for optimized type B fill.

TABLE VII

RARE EARTH METAL HALIDE LAMP SUMMARY
ELECTRODED QUARTZ LAMPS (60 Hz)

| Lamp No. | Efficacy η [lm/W] | Color Tcc [K] | CRI Ra | Wall Temp [°C.] | Fill Type | Calcium RE | Alkali RE | Alkali Additive | Wall Loading θ [W/cm²] |
|---|---|---|---|---|---|---|---|---|---|
| 86-065 | 120 | 3679 | 91.5 | — | C | 3.06 | 4.92 | 1.20 | 25.8 |
| 86-034 | 105 | 4613 | 83.4 | — | B | 3.06 | 4.92 | 1.20 | 25.9 |

Note:
The lower wall loading was due to evacuted outer envelope.

Metal iodides are usually used as additives in high pressure discharge lamps because their vapor pressure is higher than the corresponding bromides or chlorides. When only atomic emission originates from the discharge there is no advantage to using a different halide. However, when molecular emission is present, an alternate halide or mixture of halides can shift the molecular emission and desirably alter the color properties of the lamp. This is the case for the rare earth and calcium halides. The emission from the monobromide and monochloride of calcium, like calcium iodide, is also in the wavelength region 600 nm to 640 nm. Thus, CaX, where X represents a halide atom, should be a good red emitter independent of which halides are present in the lamp.

The addition of $CaX_2$ and NaI is more effective in improving the desirous color properties of the rare earth lamp than the addition of NaI alone. Na tends to dominate the spectrum at 590 nm (yellow) and produces red light due to broadening of the resonance line. This typically causes a decrease in the color temperature and an increase in efficacy at the expense of color rendition. More red in visually acute region is added by the CaX emission. The addition of small amounts of NaI increases the efficacy, decreases the color temperature and even increases the color rendering index in the presence of $CaI_2$ as shown in Table VII.

EXAMPLES

Table I entitled "Rare Earth Metal Halide Summary of Lamp Fill Ranges" list the lamp fills designated type B and type C. Fill type B contains Hg, $CeI_3$, $TmI_3$, $CaI_2$, CsI and Ar and Fill type C contains Hg, $CeI_3$, $TmI_3$, $CaI_2$, NaI and Ar.

Table II entitled "Rare Earth Metal Halide Lamps Summary" in accordance with the present invention illustrate specific examples of lamps having the fill type B as designated in Table I. The efficacy, color temperature, color rendition index, wall temperature, fill type, the wall loading, and additive molar ratios are listed.

Table III shows lamp data from individual lamps made with fill type C as designated in Table I.

Table IV shows lamp data from individual lamps with fill type B. The lamp performance as a function of rare earth concentration is shown. Table V shows lamp data from individual lamps made with fill type B. The lamp performance as a function of mercury concentration is shown.

Table VI shows reproducibility of lamp performance for the optimized type B fill.

And Table VII shows lamp data for individual electroded quartz lamps at 60 Hertz utilizing a type B and a type C fill.

This new and improved invention provides for a novel high pressure electric discharge lamp which has the desired properties of high efficacy, good color rendition and a warm color temperature. Lamps of the present invention would be good sources for more general illumination especially those applications requiring high color rendering (e.g. department store illumination).

While there has been shown and described what is at present considered the preferred embodiment of the invention, it will be obvious to those skilled in the art that various changes and modifications may be made therein without departing from the scope of the invention as defined by the appended claims.

What is claimed is:

1. An electroded high pressure electric discharge lamp having an enhanced red emission comprising:

an outer envelope, a base, a refractory inner envelope, an inner envelope support frame, two electrodes, and a fill gas;

said fill gas being contained within said refractory inner envelope, said fill gas consisting essentially of from about 1.0 to about 11.0 mg/cm$^3$ of mercury, from about 0.1 to about 4.0 mg/cm$^3$ of cerium iodide, from about 0.1 to about 4.0 mg/cm$^3$ of thulium iodide, from about 0.3 to about 13.6 mg/cm$^3$ of calcium iodide, from about 0.1 to about 4.8 mg/cm$^3$ of cesium iodide, and an inert gas;

said inner envelope, said support frame, and said electrical connectors being contained within said outer envelope;

said base being connected to said outer envelope and said electrode connectors, said electrical connectors being connected to said base, said inner envelope, and said electrodes.

2. An electroded high pressure electric discharge lamp having an enhanced red emission in accordance with claim 1 wherein said fill gas consisting essentially of from about 4.0 to about 9.0 mg/cm$^3$ of mercury, from about 0.5 to about 2.5 mg/cm$^3$ of cerium iodide, from about 0.5 to about 2.5 mg/cm$^3$ of thulium iodide, from about 1.8 to about 8.5 mg/cm$^3$ of calcium iodide, from about 0.6 to about 3.0 mg/cm$^3$ of cesium iodide, and from about 15 to about 50 Torr of argon.

3. An electroded high pressure electric discharge lamp having an enhanced red emission in accordance with claim 1 wherein said fill gas consisting essentially of about 7.0 mg/cm$^3$ of mercury, about 1.0 mg/cm$^3$ of cerium iodide, about 1.0 mg/cm$^3$ of thulium iodide, about 3.4 mg/cm$^3$ of calcium iodide, about 1.2 mg/cm$^3$ of cesium iodide, and about 45 Torr of argon.

4. An electroded high pressure electric discharge lamp having an enhanced red emission comprising:

an outer envelope, a base, a refractory inner envelope, an inner envelope support frame, two electrodes, and a fill gas;

said fill gas being contained within said refractory inner envelope, said gas fill consisting essentially of from about 1.0 to about 11.0 mg/cm$^3$ of mercury, from about 0.1 to about 4.0 mg/cm$^3$ of cerium iodide, from 0.1 to about 4.0 mg/cm$^3$ of thulium iodide, from about 0.3 to about 13.6 mg/cm$^3$ of calcium iodide, from about 0.1 to about 11.2 mg/cm$^3$ of sodium iodide, and an inert gas;

said inner envelope, said support frame, and said electrical connectors being contained within said outer envelope;

said base being connected to said outer envelope and said electrode connectors, said electrical connectors being connected to said base, said inner envelope, and said electrodes.

5. An electroded high pressure electric discharge lamp having an enhanced red emission in accordance with claim 4 wherein said fill gas consisting essentially of from about 4.0 to about 9.0 mg/cm$^3$ of mercury, from about 0.5 to about 2.5 mg/cm$^3$ of cerium iodide, from about 0.5 to about 2.5 mg/cm$^3$ of thulium iodide, from about 1.8 to about 8.5 mg/cm$^3$ of calcium iodide, from about 1.4 to about 7.0 mg/cm$^3$ of sodium iodide, and from about 15 to about 50 Torr of argon.

6. A high pressure electric discharge lamp having an enhanced red emission in accordance with claim 4 wherein said fill gas consisting essentially of about 7.0 mg/cm$^3$ of mercury, about 1.0 mg/cm$^3$ of cerium iodide, about 1.0 mg/cm$^3$ of thulium iodide, about 3.4 mg/cm$^3$ of calcium iodide, about 2.8 mg/cm$^3$ of sodium iodide, and about 45 Torr of argon.

7. An electrodeless high pressure electric discharge lamp having an enhanced red emission comprising:

a refractory inner envelope containing a fill gas;

said fill gas being contained within said refractory inner envelope, said fill gas consisting essentially of from about 1.0 to about 11.0 mg/cm$^3$ of mercury, from about 0.1 to about 4.0 mg/cm$^3$ of cerium iodide, from about 0.1 to about 4.0 mg/cm$^3$ of thulium iodide, from about 0.3 to about 13.6 mg/cm$^3$ of calcium iodide, from about 0.1 to about 4.8 mg/cm$^3$ of cesium iodide, and an inert gas.

8. An electrodeless high pressure electric discharge lamp having an enhanced red emission in accordance with claim 7 wherein said fil gas consisting essentially of from about 4.0 to about 9.0 mg/cm$^3$ of mercury, from about about 0.5 to about 2.5 mg/cm$^3$ of cerium iodide, from about 0.5 to about 2.5 mg/cm$^3$ of thulium iodide, from about 1.8 to about 8.5 mg/cm$^3$ of calcium iodide, from about 0.6 to about 3.0 mg/cm$^3$ of cesium iodide, and from about 2.8 to about 7.5 Torr of argon.

9. An electrodeless high pressure electric discharge lamp having an enhanced red emission in accordance with claim 7 wherein said fill gas consisting essentially of about 7.0 mg/cm$^3$ of mercury, about 1.0 mg/cm$^3$ of cerium iodide, about 1.0 mg/cm$^3$ of thulium iodide, about 3.4 mg/cm$^3$ of calcium iodide, about 1.2 mg/cm$^3$ of cesium iodide, and about 5.0 Torr of argon.

10. An electrodeless high pressure electric discharge lamp having an enhanced red emission comprising:

a refractory inner envelope containing a fill gas;

said fill gas being contained within said refractory inner envelope, said fill gas consisting essentially of from about 1.0 to about 11.0 mg/cm$^3$ of mercury, from about 0.1 to about 4.0 mg/cm$^3$ of cerium iodide, from about 0.1 to about 4.0 mg/cm$^3$ of thulium iodide, from about 0.3 to about 13.6 mg/cm$^3$ of calcium iodide, from about 0.1 to about 11.2 mg/cm$^3$ of sodium iodide, and an inert gas.

11. An electrodeless high pressure electric discharge lamp having an enhanced red emission in accordance with claim 10 wherein said fill gas consisting essentially of from about 4.0 to about 9.0 mg/cm$^3$ of mercury, from about 0.5 to about 2.5 mg/cm$^3$ of cerium iodide, from about 0.5 to about 2.5 mg/cm$^3$ of thulium iodide, from about 1.8 to about 8.5 mg/cm$^3$ of calcium iodide, from about 1.4 to about 7.0 mg/cm$^3$ of sodium iodide, and from about 2.8 to about 7.5 Torr of argon.

12. An electrodeless high pressure electric discharge lamp having an enhanced red emission in accordance with claim 10 wherein said fill gas consisting essentially of about 7.0 mg/cm$^3$ of mercury, about 1.0 mg/cm$^3$ of cerium iodide, about 1.0 mg/cm$^3$ of thulium iodide, about 3.4 mg/cm$^3$ of calcium iodide, about 2.8 mg/cm$^3$ of sodium iodide, and about 5.0 Torr of argon.

13. An electroded high pressure electric discharge lamp having an enhanced red emission comprising:

an outer envelope, a base, a refractory inner envelope, an inner envelope support frame, two electrodes, and a fill gas;

said fill gas consisting essentially of mercury, cerium iodide, thulium iodide, cesium iodide, calcium iodide, sodium iodide and an inert gas;

said fill gas being contained within said refractory inner envelope, said inner envelope, said support frame, and said electrical connectors being contained within said outer envelope, said base being connected to said outer envelope and said electrode connectors, said electrical connectors being connected to said base, said inner envelope, and said electrodes.

14. An electrodeless high pressure electric discharge lamp having an enhanced red emission comprising:

a refractory inner envelope containing a fill gas;

said fill gas consisting essentially of mercury, cerium iodide, thulium iodide, cesium iodide, calcium iodide, sodium iodide and an inert gas;

said fill gas being contained within said refractory inner envelope.

* * * * *